US009162280B2

(12) United States Patent
Westmoreland et al.

(10) Patent No.: US 9,162,280 B2
(45) Date of Patent: Oct. 20, 2015

(54) HYBRID CERAMIC/SAND CORE FOR CASTING METAL ENGINE PARTS WITH PASSAGES OR HOLES HAVING A CROSS SECTION TOO SMALL FOR SAND CASTING

(71) Applicant: Southwest Research Institute, San Antonio, TX (US)

(72) Inventors: Barry E. Westmoreland, Adkins, TX (US); Douglas A. McKee, Helotes, TX (US); Marc C. Megel, La Vernia, TX (US); Mark A. Tussing, San Antonio, TX (US); Thomas E. Reinhart, Boerne, TX (US); David P. Branyon, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 129 days.

(21) Appl. No.: 13/948,449

(22) Filed: Jul. 23, 2013

(65) Prior Publication Data

US 2015/0027658 A1 Jan. 29, 2015

(51) Int. Cl.

| | |
|---|---|
| ***B22C 9/10*** | (2006.01) |
| ***B22D 15/02*** | (2006.01) |
| ***B22D 25/02*** | (2006.01) |

(52) U.S. Cl.

CPC . *B22C 9/10* (2013.01); *B22C 9/103* (2013.01); *B22D 15/02* (2013.01); *B22D 25/02* (2013.01)

(58) Field of Classification Search

CPC ..... B22C 9/10; B22C 9/103; B22D 15/02; B22D 25/02

USPC ..... 164/19–22, 28, 200–202, 369

See application file for complete search history.

(56) References Cited

U.S. PATENT DOCUMENTS

| | | | | |
|---|---|---|---|---|
| 8,267,148 | B1 | 9/2012 | Megel et al. | |
| 2005/0247428 | A1 * | 11/2005 | Cantu-Gonzalez et al. | 164/138 |
| 2011/0169186 | A1 * | 7/2011 | Bruman et al. | 264/138 |
| 2012/0031354 | A1 * | 2/2012 | Beyer et al. | 123/41.79 |
| 2012/0085299 | A1 * | 4/2012 | Kuhlbach et al. | 123/41.72 |

* cited by examiner

*Primary Examiner* — Kevin E Yoon

(74) *Attorney, Agent, or Firm* — Livingston Law Office; Ann C. Livingston

(57) ABSTRACT

A hybrid ceramic/sand casting method of manufacturing a metal part. The method is especially suitable for manufacturing engine cylinder blocks or cylinder head, which have very small internal passages or other very small internal features. These parts are formed using a hybrid core having at least one ceramic section and at least one sand section, with the ceramic section being used to create the internal feature. A mold cavity is created for the part, and the hybrid core is positioned in the mold. Molten metal is introduced into the mold, and after the metal cools, the core is removed, thereby forming the part with the internal feature.

11 Claims, 12 Drawing Sheets

HYBRID CERAMIC/SAND CORE FOR CASTING METAL ENGINE PARTS WITH PASSAGES OR HOLES HAVING A CROSS SECTION TOO SMALL FOR SAND CASTING

TECHNICAL FIELD OF THE INVENTION

This invention relates to sand casting for the manufacture of metal engine parts, and more particularly to methods of using a hybrid ceramic/sand core for making parts having small passages or holes.

BACKGROUND OF THE INVENTION

Sand casting, also known as sand molded casting, is a process for casting parts, normally metal parts, characterized by using sand as the mold material. A suitable bonding agent is mixed with the sand to develop coherency for molding and strength and stiffness of the cured mold.

For manufacturing metal objects, the basic steps of the sand casting process are quite simple. A pattern is made for the object to be produced, typically using wood, metal, or a plastic. The pattern is placed in a suitable sand mixture, contained and cured in a casting box, to create a sand mold. The pattern is removed, to form the mold cavity, and the mold cavity is filled with molten metal. After the metal cools, the sand mold is broken away leaving the desired casting.

To produce internal holes and passages within the casting, "cores" are used. A core is formed independently of the sand mold, usually also from sand, then positioned in the mold cavity, with some means for supporting the core in position. The positioning means may be one or more recesses in the pattern called "core prints" or small supporting pieces between the core and cavity surface called "chaplets". Then, the molten metal is introduced as described above.

Although sand cores are useful, the cross section size of the internal passages made using sand cores is limited. This is because as sand core cross section dimensions are reduced, the core's ability to resist premature breakdown in the presence of molten metal is also reduced. Thus, there are limiting dimensions below which a sand core will disintegrate during casting by effects that include thermal shock, evaporation of binder and penetration of the sand core.

Internal combustion engines contain numerous flow passages for delivery of fluids (such as fuel, lubricant, coolant and air) to various locations throughout the engine. It is desirable that as many of these passages as possible be contained within the cast material of components such as the cylinder block and cylinder head, to avoid external plumbing and additional parts count.

However, many of these engine passages are too small to cast using conventional sand core casting methods, and therefore they must be machined separately after the components are cast. This normally requires a sequence of machined features, typically drillings, which intersect to create flow networks. Because machining requires straight "line-of-sight" access to locate the features, the flexibility of their placement, orientation and shape is very limited. Additionally, in some engines the passages are long and consequently difficult to machine. Also, many of these drillings must be plugged to seal one end, which requires further machining and creates potential fluid leak paths.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to casting methods of manufacturing internal combustion engine parts, using hybrid ceramic and sand cores. It is assumed that the part to be manufactured is to be made from cast metal, and that it has at least one internal passage or hole.

A common feature of the various embodiments described herein is a hybrid core for a part having passages or holes with a cross section too small to be made with sand casting. As indicated in the Background, a "core" is a device used in casting to produce internal cavities, passages and holes. After casting, the core is destroyed to remove it from the part.

The core is "hybrid" in the sense that it has both sand and ceramic sections joined together to form a single core structure. A ceramic section is used in a region that forms the small passage or hole. The ceramic section allows much smaller passages and holes to be formed than those achievable using a traditional core made entirely of sand.

For purposes of example, the embodiments herein are described in terms of manufacturing parts of an internal combustion engine. The methods are consistent with the methods described in U.S. Pat. No. 8,267,148, entitled "Hybrid Ceramic/Sand Core for Casting Metal Parts Having Small Passages", to Megel, at al, assigned to Southwest Research Institute, and incorporated by reference herein.

The ability to cast the engine parts described below decreases engine production cost by reducing machining requirements. The casting methods allow more flexibility in engine design, such as for additional structural strength, reduced pressure losses, and better cooling.

Overview of Casting Method

Figure 1:
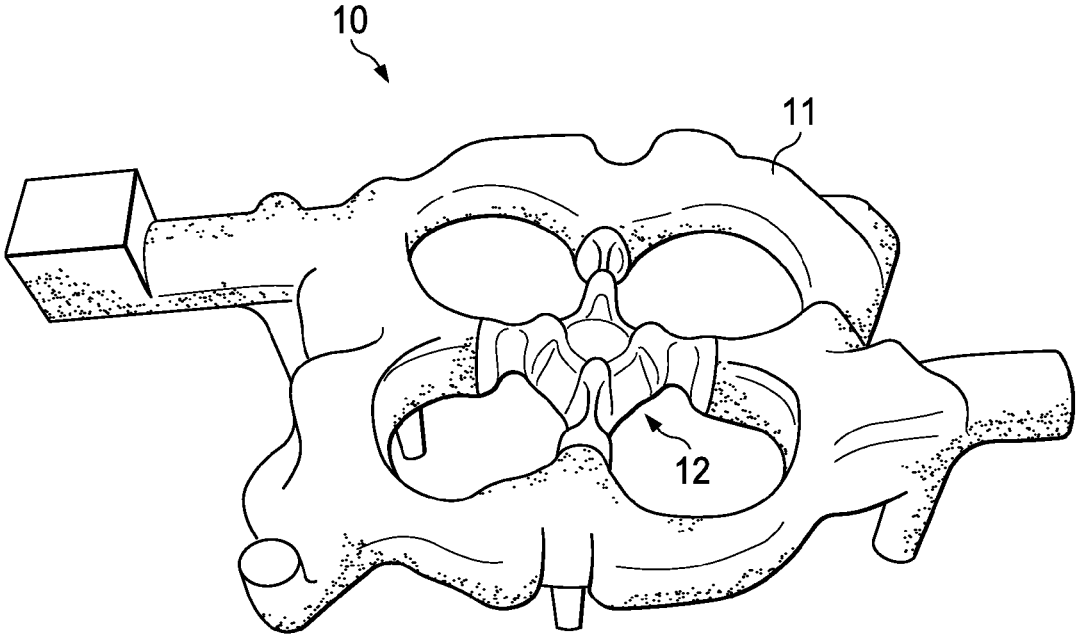
FIG. 1 illustrates a hybrid core for use during a sand casting process.

FIG. 1 illustrates a hybrid casting core 10 in accordance with the invention. The core 10 has both a sand section 11 and a ceramic section 12, which are joined together to form a single structure. Various means may be used for attaching the sand section 11 to the ceramic section 12, with one example given below.

In the example of FIG. 1, the ceramic section 12 is used in the region that forms coolant passages between the engine's gas exchange port walls and injector/igniter boss. More specifically, the ceramic section 12 is used to form valve bridge passages as well as the annulus around each cast injector sleeve. The use of ceramic for this part of the core allows much smaller passages to be formed than those achievable using a traditional core made entirely of sand. This enables key design features of a high pressure cylinder head, such as thick port walls and an integral injector/igniter boss, to be cast with passages for adequate coolant exposure.

The ceramic section 12 of core 10 may be manufactured by various means, with one example being an injection molding process. Because only a small portion of the casting core pack is made of ceramic, the economic impact is acceptable, both from a raw materials standpoint and level of effort required for core extraction after casting. Although conventional methods for removing sand cores may not be suitable, alternative methods are known and used in foundries today. For example, to remove the ceramic section 12, a caustic solution cleaning process may be used to leach the core out of the finished casting.

Figure 2:
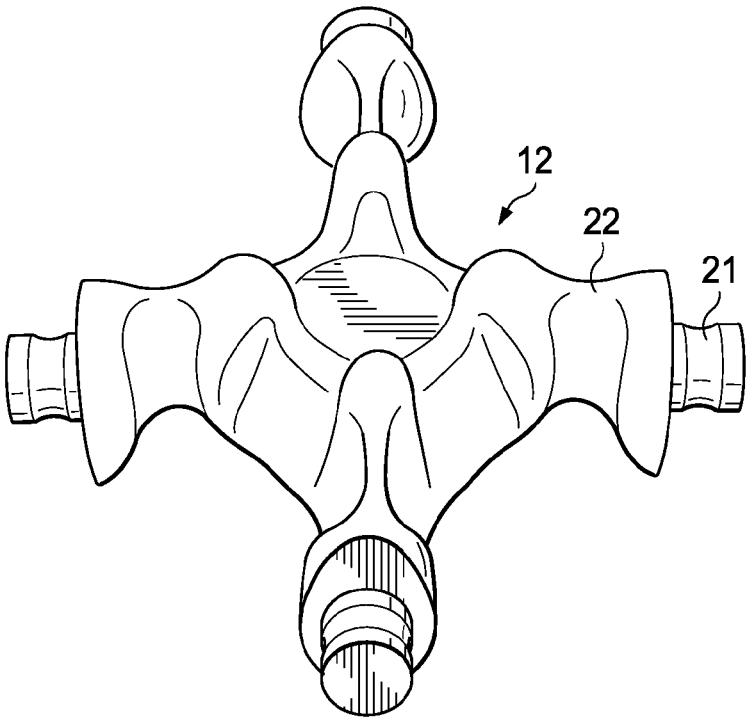
FIG. 2 illustrates the ceramic section of the hybrid core of FIG. 1.

FIG. 2 illustrates one method of attachment between the ceramic section 12 and sand section 11. Other methods can be used, but in the example of FIG. 2, a mechanically captive interface is formed by blowing sand around small lugs protruding from the ceramic section 12. Upon curing of the binder resin in the sand, the ceramic is captured by the sand.

In FIG. 2, the ceramic section 12 of FIG. 1 is shown before attachment to the sand core section 11. The ceramic section 12 has four "spars" that will form passages. An attachment lug 21 is part of the ceramic section 12 on the end of each of the four spars 22. The lugs may be formed during the molding of the ceramic section as an integral part of the ceramic section.

The lug attachment means of FIG. 2 is especially suitable for a ceramic section having a "hub" and "spar" configuration, in which a lug can be formed at the far end of each spar.

Except for the attachment of the ceramic section 12, the sand section 11 of core 10 may be made by conventional means. It may be made by mixing sand with a binder in a wooden or metal core box, which contains a cavity in the shape of the desired core.

Embodiments

The various embodiments described below are directed to manufacturing engine parts for a reciprocating piston internal combustion engine. These parts may be the engine cylinder block or cylinder head, which are made from cast metal.

These parts have a least one small feature, such as a passage or hole for passage of fluids, such as coolant, lubricant, fuel, or air. For purpose of this description, these passages and holes are collectively referred to as "passages" because of their common function of conveying engine fluids. Each of these passages has a diameter, cross section or radius of curvature too small for casting with a sand core. For purposes of this description, that constraint is assumed to be less than 10 millimeters in diameter (or other cross sectional dimension} or 5 millimeters in radius of curvature.

As explained below, at least one hybrid sand/ceramic core or ceramic core is used to manufacture the cylinder block or cylinder head. These cores are part of a "core pack", which may also include conventional sand cores. The core pack is a collection of these cores (hybrid, ceramic, and sand), which are assembled in a particular manner for casting of the cylinder block or cylinder head. The core pack represents and will determine the internal cavities of the engine.

The outside structure of the casting is determined by an outer mold. Molten metal is poured into the mold, filling the spaces not filled by the core pack. The cores are subsequently removed, leaving the metal casting. Thus, the cavities, passages and holes formed by the core pack are "internally cast" in the sense that they are not machined into the engine block.

In practice, for a particular part to be cast, the size of small features such as passages will be measured. It is expected that as alternatives to a sand core, a hybrid core or an all ceramic core will be used in a part having an internal passage or hole of less than 10 mm in cross section. For purposes of this description, by "internal passage" is meant any linear passage or circular opening or hole in the engine part that occurs by being made with a core inside the mold cavity. The passage will have a measurable cross sectional dimension (including but not limited to width or diameter).

A hybrid core will be part sand and part ceramic in accordance with the method described above in connection with FIGS. 1 and 2. The ceramic sections are used for making the small passages. Hybrid cores for an interbore coolant jacket, an air intake port, coolant jacket flow tubes, and coolant jacket surfaces are described below in connection with FIGS. 3 and 4, FIGS. 7-9, FIGS. 10 and 11, and FIG. 12, respectively. Other cores for small passages may be completely ceramic, as in the case of the fluid flow passages described below in connection with FIGS. 5 and 6.

The core pack is "hybrid" in the sense that it is an assembly of cores, some of which are sand, some sand-ceramic, and/or some ceramic. A feature of the hybrid core casting method described herein is that only a very small portion of the overall core of a large part (such as a cylinder block or cylinder head) need be made from ceramic. Most of the core can be removed by traditional mechanical extraction techniques.

Interbore Coolant Jacket within Cylinder Block

Figure 3:
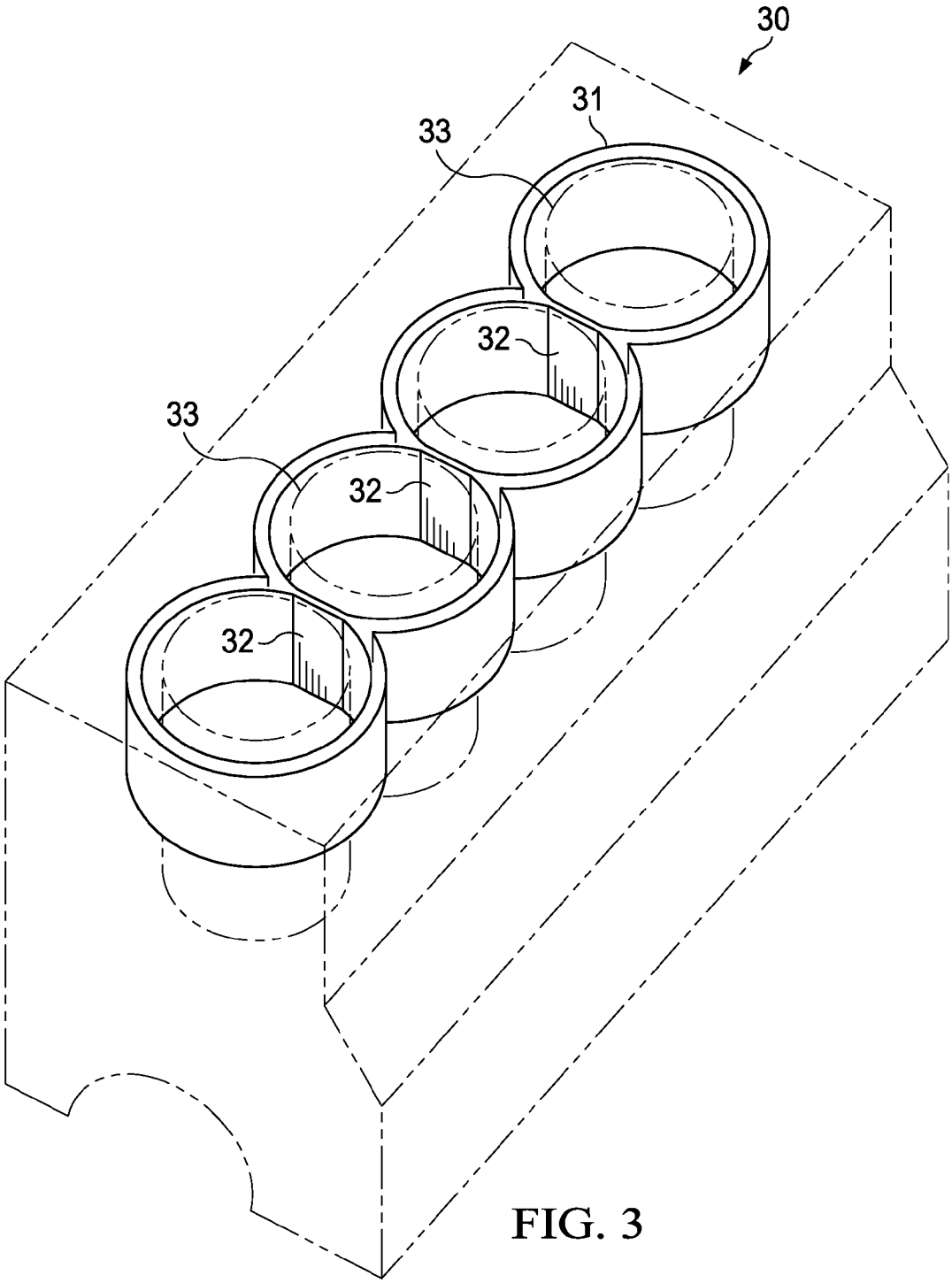
FIG. 3 is a perspective view of an engine cylinder block having an interbore coolant jacket.

FIG. 3 is a perspective view of an engine cylinder block 30 having an interbore coolant jacket 31. Cylinder block 30 is for an engine having four cylinders, which are not explicitly shown—in an operating engine, the cylinders would be located inside the cylinder bores 33. The cylinder bores 33 are arranged linearly, and the coolant jacket 31 surrounds the cylinder bores 33.

A "coolant jacket" is actually a network of hollow passages in the metal engine block. Coolant jackets allow liquid coolant to flow around the cylinders through the hollow passages in the metal engine block. The coolant absorbs heat from combustion, then flows to other cooling system components where it transfers heat to the atmosphere. A coolant jacket is also sometimes referred to as a "water jacket", but it should be understood that it is designed to contain and allow flow of any suitable coolant.

In FIG. 3, the narrow region of the coolant jacket 31 that is formed between two cylinders is known as the interbore bridge 32. In the example of FIG. 3, coolant jacket 31 has three interbore bridges 32. Thus, the coolant jacket 31 extends between the cylinders, as opposed to other designs in which the coolant jacket does not. For purposes of this description, it is assumed that the interbore bridges are less than 10 millimeters wide.

Other than the interbore bridges 32 between the cylinders, the specific geometry of the coolant jacket 31 is not important to the invention. The coolant jacket 31 depicted in FIG. 3 is typically in fluid communication with a larger network of coolant passages, thus coolant jacket 31 may be a portion of a larger coolant jacket. The interbore bridge 32 is easily overheated from combustion within the cylinders and from the friction between the piston assembly and cylinder wall, thus the passage it allows between cylinders is an important part of coolant jacket 31.

The depiction of FIG. 3 could also be considered to be the outline of a casting core for the interbore coolant jacket 31. This core would be used to create an internally cast coolant flow passage around and between the cylinders.

Figure 4:
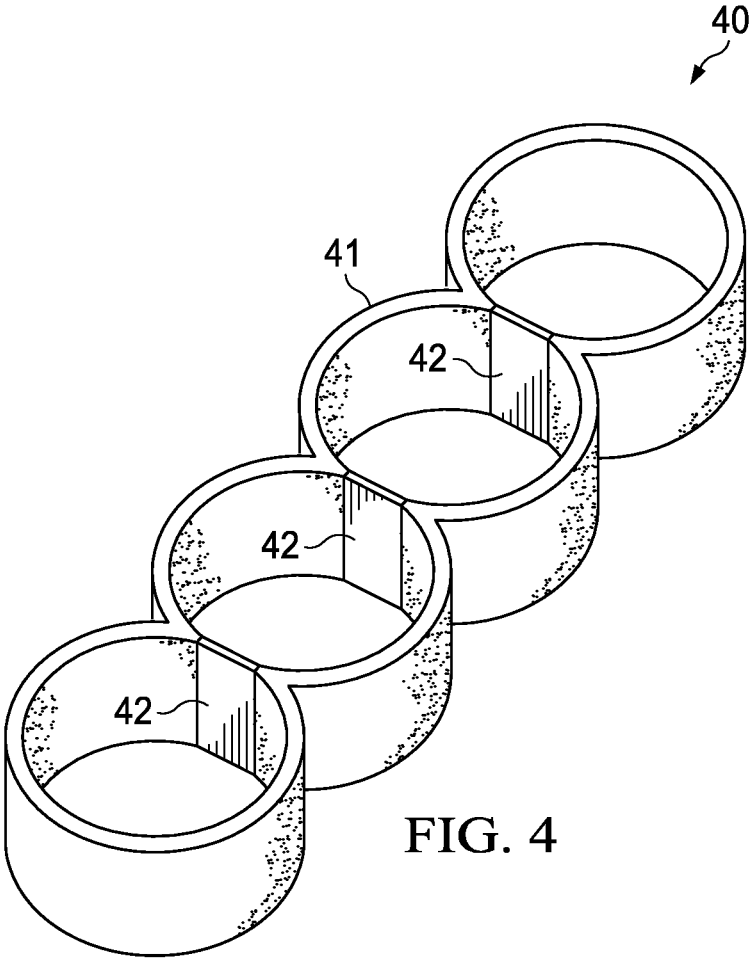
FIG. 4 illustrates a hybrid core for the interbore coolant jacket of FIG. 3.

FIG. 4 illustrates a casting core 40 for the interbore coolant jacket 31. Consistent with the methods described above, core 40 has sand sections 41 and ceramic sections 42. As explained above, it is assumed that the core 40 has been formed in a core box, or by other suitable means, and is for use to cast the engine block 10.

The interbore bridge 32 is narrow, and the core for this region is formed with ceramic sections 42. These bridge passages can be as narrow as 1 mm, which cannot be accomplished with conventional casting techniques. In some conventional engines, the jackets are "partial" in the sense that the jacket does not create a passage in the interbore region and that region is not cooled. In other conventional engines, the interbore region is cooled with machined drillings in the interbore region of a partial jacket.

Thus, core 40 has three ceramic sections 42, each of which will form an interbore bridge coolant passage. This coolant passage section between cylinders can be between 1 mm and 5 mm based on available space. As described above, the ceramic sections 42 are of a size and shape when a sand core would not be feasible due to insufficient space and/or size constraints of the desired interbore passage.

Fluid Flow Lines within Cylinder Block

Figure 5:
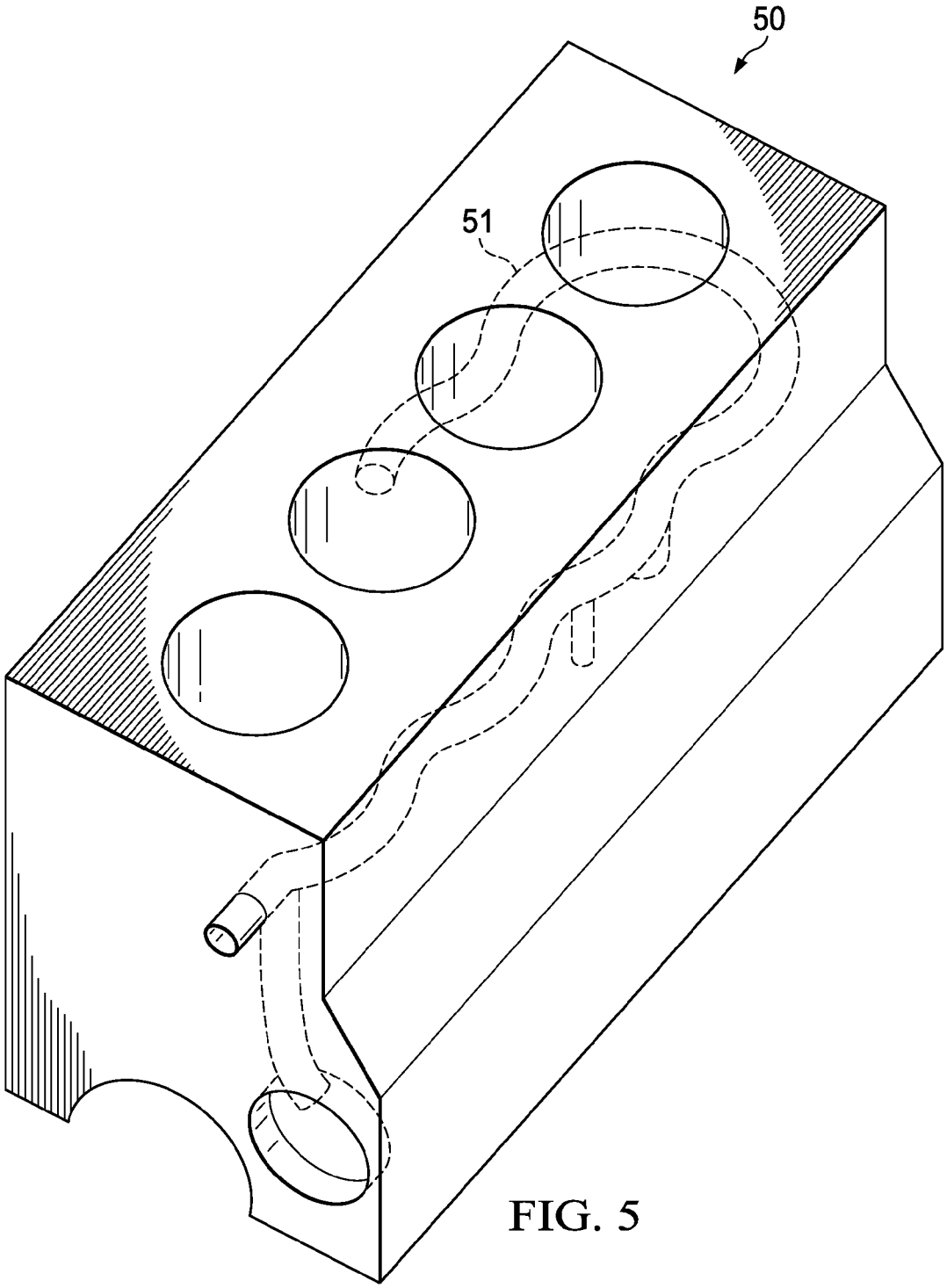
FIG. 5 illustrates an engine cylinder block having an oil passage network.

FIG. 5 illustrates an engine cylinder block 50 and a portion of an internal oil flow network 51 for providing lubricant to various locations within the engine block. Other than the features described below for which ceramic cores are used, the specific geometry of the oil flow network is not significant to the invention, and various geometries may be implemented.

Oil flow network 51 is shaped for optimized fluid flow characteristics as well as structural strength of the cylinder block. Smooth radii replace sharp edges and therefore reduce pressure losses in the oil network. This will allow a lower upstream supply pressure to achieve the same downstream pressure requirement. The supply pump size and the parasitic power requirements for pumping can be reduced, resulting in reduced fuel consumption of the engine.

Figure 6:
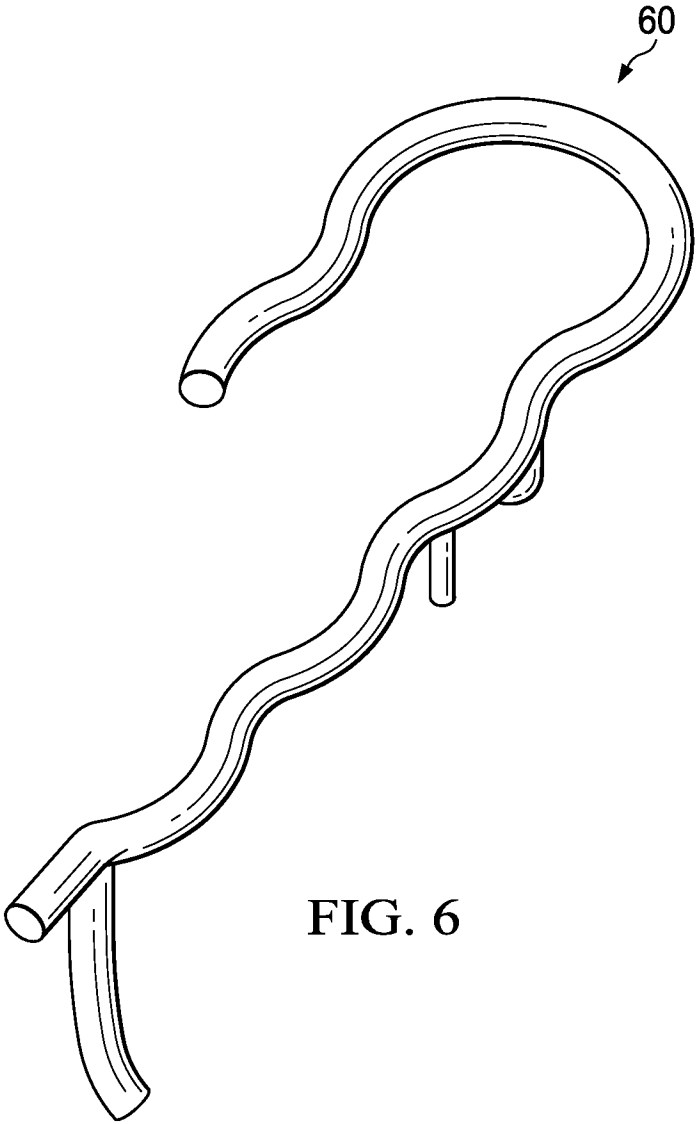
FIG. 6 illustrates a hybrid core for the oil passage network of FIG. 5.

FIG. 6 illustrates an example of a ceramic core 60 for oil passage network 51. The illustration of core 60 for an oil passage network is for purposes of example—the same type of core could be used for any fluid flow passage network within the engine block, such as for fuel or coolant.

Oil flow network 51 has sections with cross sections of less than 5 mm, and as small as 1 mm, where ceramic cores are used for the casting. The network 51 may also include sections with tapered forms, bend radii and length dimensions not achievable with sand cores. To form each small tapered section, small bend radii or short length section of less than 5 millimeters in diameter or length, core 60 is made from a ceramic material. The core is then used during the casting process for the engine cylinder block.

The use of ceramic for core 60 allows the oil passages to be no longer limited to fixed circular cross sectional shape; they may be tapered or contoured as best suits the engine. For example, tapered cross sections or progressively increasing diameters as the circuit progresses could be used to provide identical pressure supply to components at different points in the circuit. The ability to make arcing, non-linear passages will also allow them to be more judiciously located with respect to highly stressed structural sections of the engine, thereby providing a structural strength benefit.

Air Intake Port in Cylinder Head

Air intake ports of internal combustion engines may incorporate geometric features that impart specific motion characteristics to the air charge during the induction phase of the engine's operation. One common arrangement is associated with the production of a helical swirl of the incoming air to set up rotation of the flow field about the longitudinal axis of the intake port.

Figure 7:
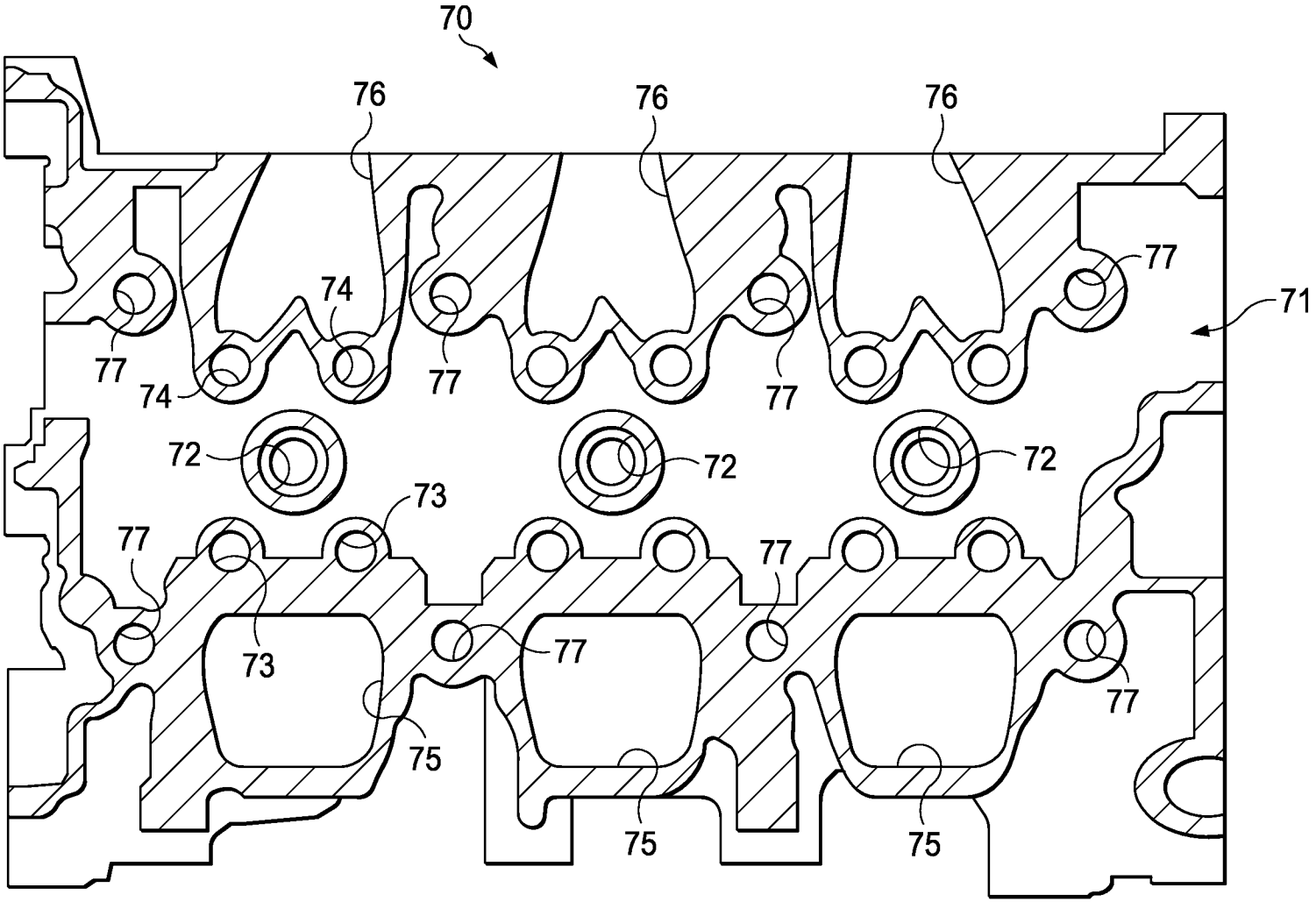
FIG. 7 is a cut-away plan view of an engine cylinder head.

FIG. 7 is a cut-away plan view of a cylinder head 70 with a conventional coolant jacket 71. In a typical engine, the cylinder head 70 is bolted to a cylinder block, such as the cylinder block of FIG. 3. Like the cylinder block, the cylinder head 70 is cast from a suitable metal.

Coolant jacket 71 provides a coolant path within the cylinder head 70. The coolant jacket 71 provides a coolant path around spark plug bores 72, intake valve holes 73 and exhaust valve holes 74. Intake ports 75, exhaust ports 76 and cylinder bolt holes 77 are also shown in cross section.

Figure 8:
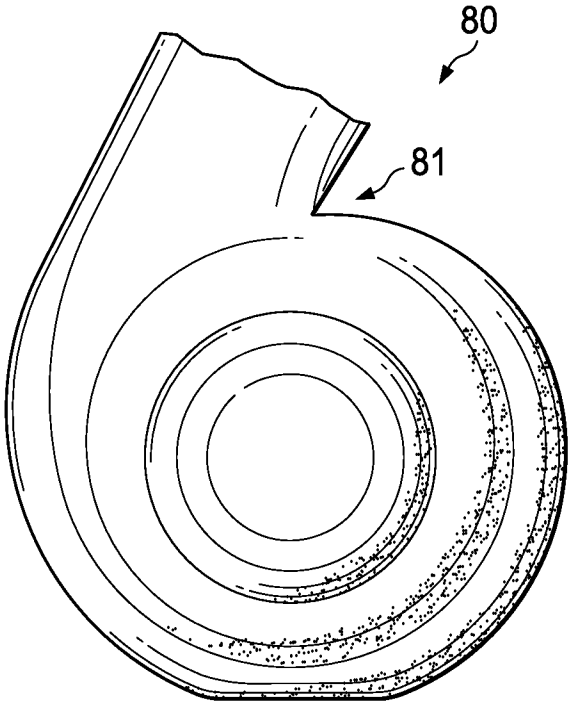
FIG. 8 illustrates an engine cylinder head air intake port designed for helical swirl generation.

FIG. 8 is a top view of a core 80 for an engine cylinder head air intake port 75 designed for helical swirl generation. It has feature geometry, a swirl radius, of less than 5 mm. The effect of a very small (effectively "sharp") radius at the edge of the runner portion 81 of the intake port 75 is to create better flow separation from the port wall. This aids formation of helical swirl without reducing the flow coefficient of the port. Ultimately this increases the airflow capacity of a given engine for a given amount of swirl and will increase the power production potential.

Figure 9:
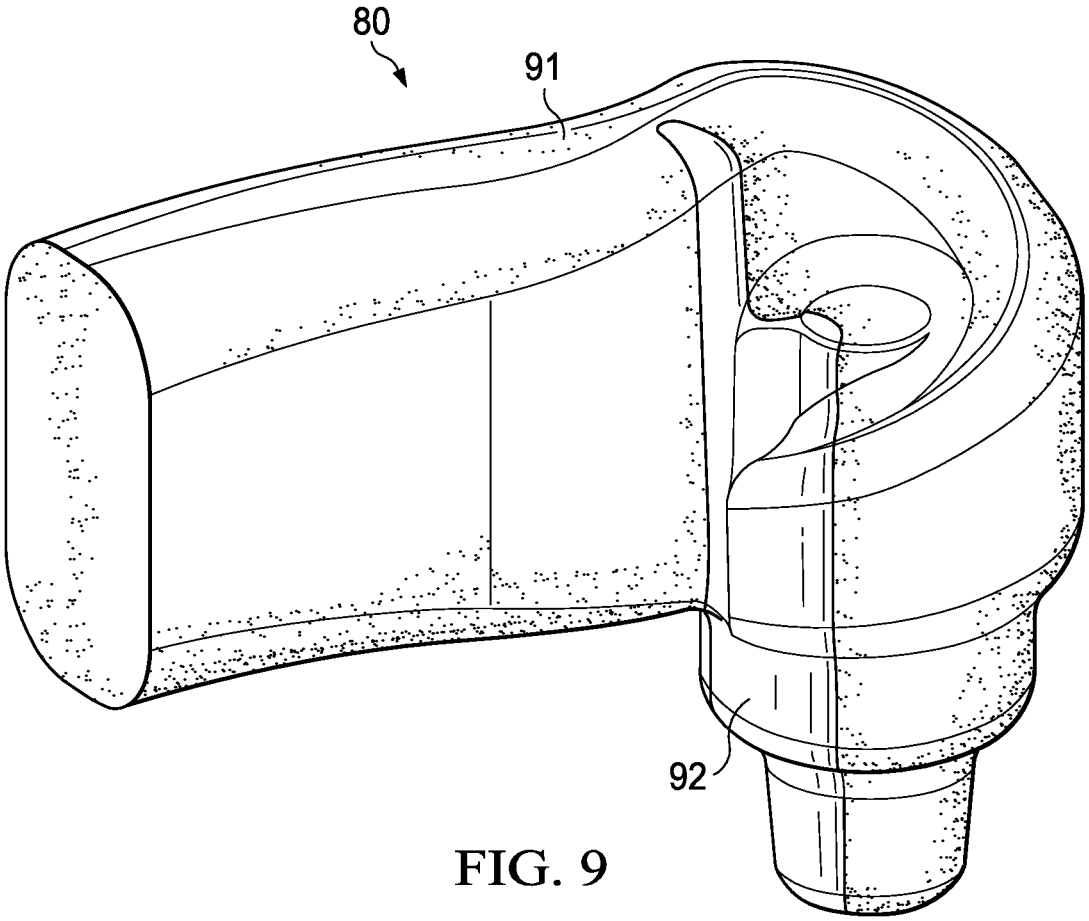
FIG. 9 illustrates a hybrid core for the air intake port of FIG. 8.

FIG. 9 illustrates core 80 in further detail, showing how core 80 is part sand core 91 and part ceramic core 92. The ceramic core 92 includes the sharp radius described above.

Cylinder Head Coolant Jacket Flow Tubes

Combustion chambers of reciprocating piston internal combustion engines are typically bounded, in part, by the cylinder head. During engine operation, the cylinder head metal temperature must be limited to values well below combustion temperatures in order to prevent material failure. This is typically accomplished by forced convection heat transfer to a flowing liquid coolant. The coolant flows through the cylinder head in an internally cast passage known as a cylinder head coolant jacket.

Referring again to FIG. 7, a cylinder head 70 may be cast with sand cores that create a conventional cylinder head coolant jacket 71. The coolant jacket 71 provides a coolant path within the cylinder head 70. Like the parts, discussed above, the coolant jacket 71 is made by first making a core, and then using the core during the metal casting process. The coolant jacket 71 provides a coolant path around spark plug bores 72, intake valve holes 73 and exhaust valve holes 74.

Figure 10:
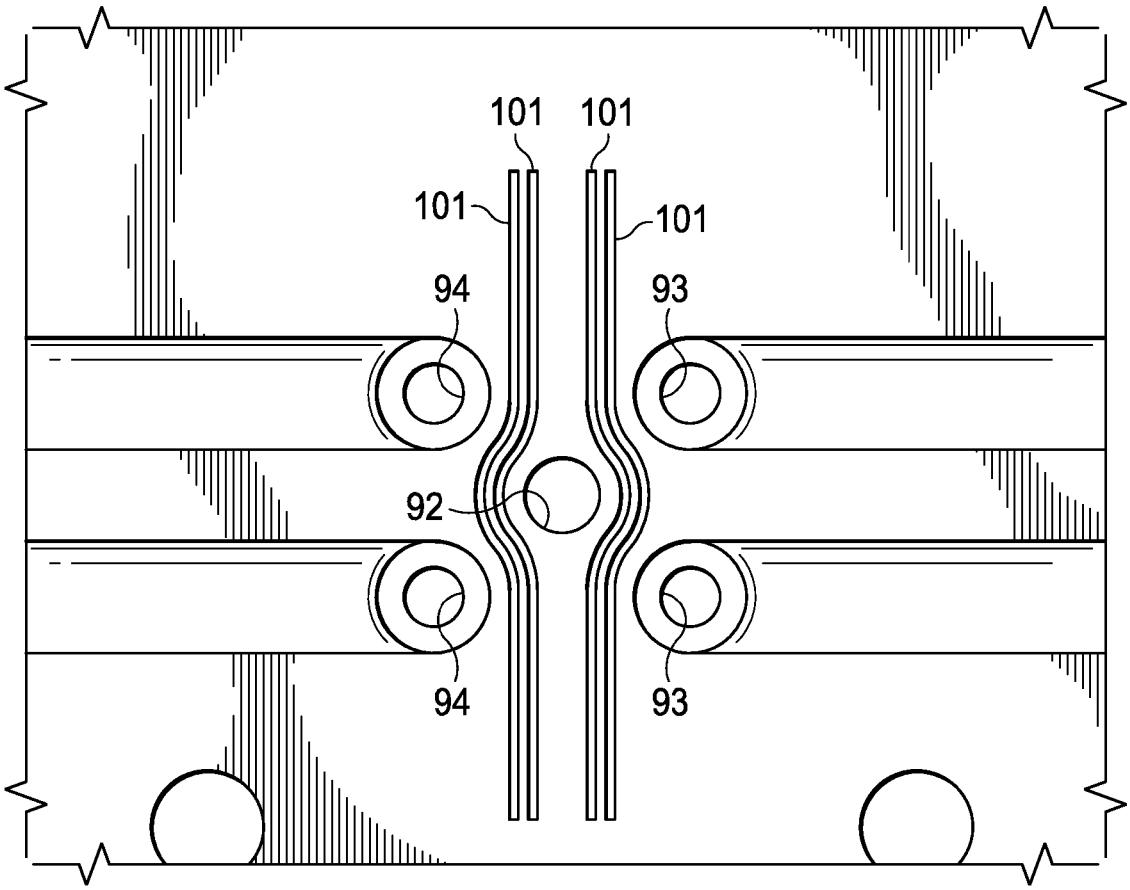
FIG. 10 illustrates a new cylinder head coolant jacket design consisting of numerous small flow channels.

FIG. 10 illustrates a new cylinder head coolant jacket design consisting of numerous small flow channels 101. Flow channels 101 enable precise coolant velocity and directional flow control as well as increased surface area for improved heat transfer rates and reduced coolant volume. These flow channels 101 may be made with hybrid cores, with ceramic cores for any portion of the flow channel having a cross section dimension of less than 5 mm. The core cross section dimensions, and hence the cross section dimensions of the resulting flow channels 101, may be as small as approximately 1 mm.

As illustrated, the bores for the intake and exhaust valves generally define a rectangular area above the cylinder that they serve. The spark plug bore is in the center of this rectangular area. In the example of FIG. 10 the flow channels 101 are placed in the plane of the cylinder head, and at least four flow channels 101 flow across this rectangular area. Although not explicitly shown, these flow channels continue across the cylinder head in a similar manner to cool the area above each cylinder. The flow channels 101 may curve into the gap between the pairs of intake or exhaust valves to provide improved cooling.

Figure 11:
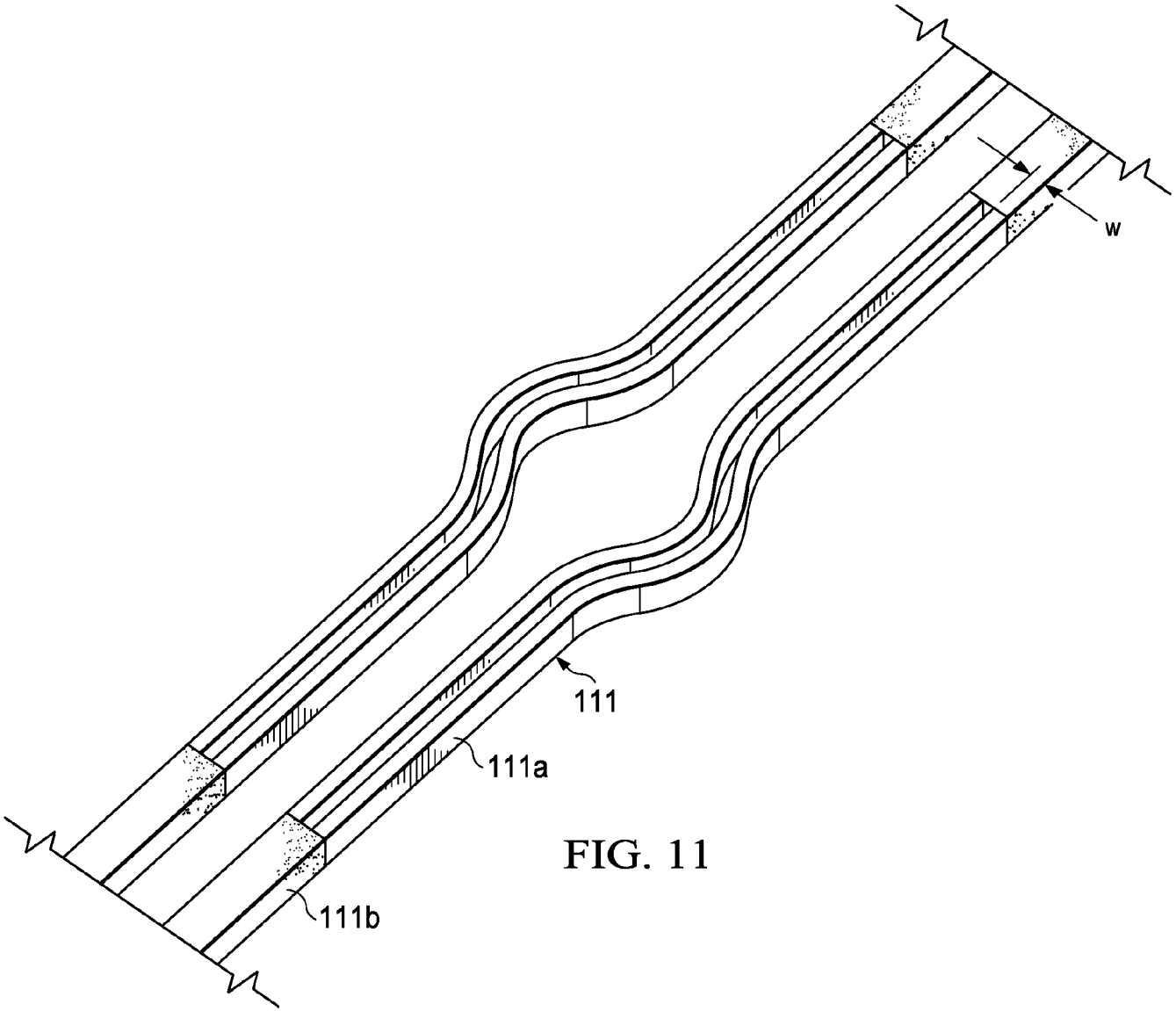
FIG. 11 illustrates an example of hybrid cores for the coolant jacket flow channels illustrated in FIG. 10.

FIG. 11 illustrates an example of casting cores 111 for the coolant jacket flow channels 101 illustrated in FIG. 10. Each core 111 uses ceramic material for the portions 111*a* of the core having narrow cross sections 111*a*, but transitions to sand material for the portions 111*b* of the core having wider cross sections. The dimension, w, of the ceramic sections 111*a* may be within a range of 1-5 mm.

The flow channels 101 of FIG. 10 and the cores of FIG. 11 are generally rectangular in cross section, but could be rounded in cross section. Any tubular passages may be used. Thus, for purposes of this invention, the "width" is equivalent to the diameter of a round flow channel and both a termed "cross sectional area" for purposes of this description.

Cylinder Head Coolant Jacket Surface

Referring again to FIG. 7, the coolant jacket 71 of the cylinder head 70 surrounds various bores for valves and spark plugs. The coolant jacket 71 typically extends from one end of the cylinder head to the other, and exposes the combustion chambers to coolant. It surrounds the intake and exhaust valves bores, as well as the spark plug bore.

For cooling purposes, a critical surface of the cylinder head is the surface of the coolant jacket located immediately above the combustion chamber of any given cylinder. In the view of FIG. 7, that critical surface would be under the area generally circumscribed by the valve bores 73 and 74 and under the spark plug bore 72.

Figure 12:
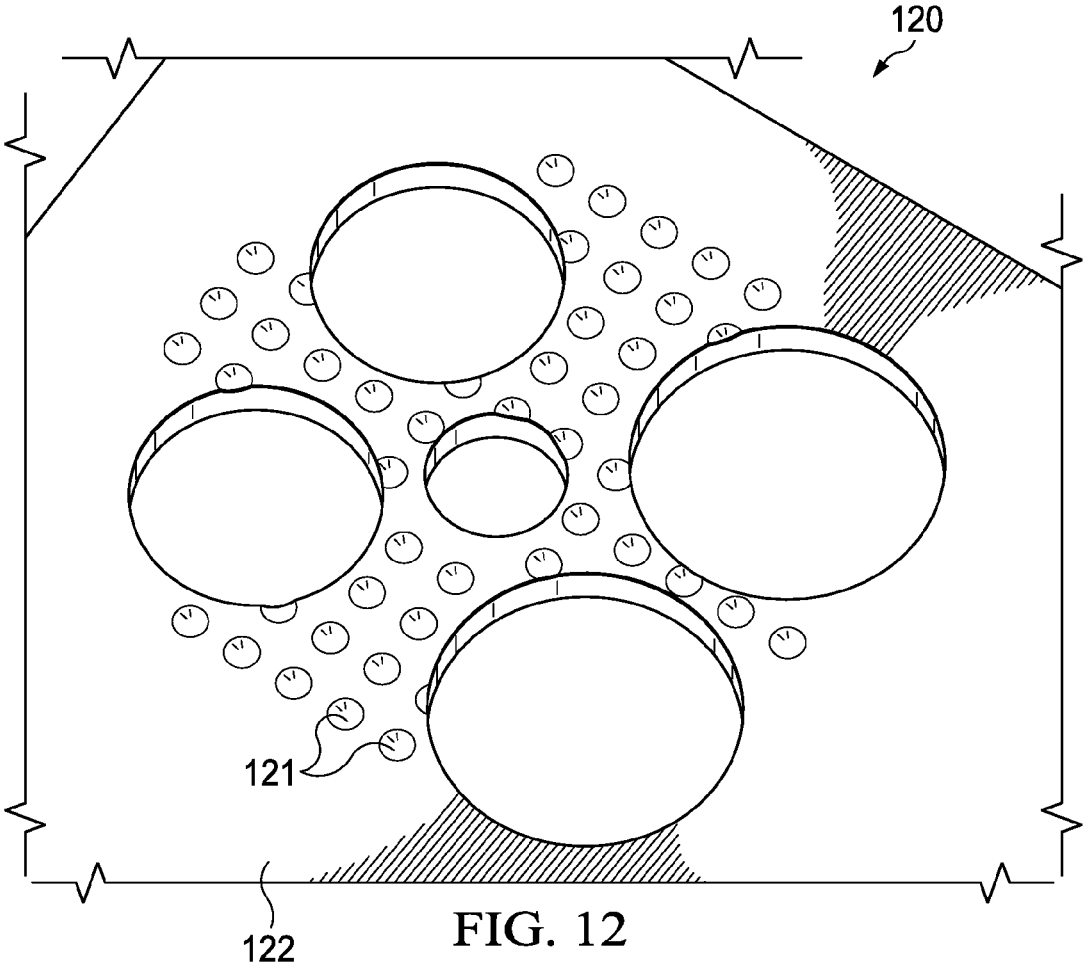
FIG. 12 illustrates a hybrid core used to make a cylinder head coolant jacket, such as that of FIG. 7.

FIG. 12 illustrates a portion of a hybrid sand/ceramic core 120 used to make cylinder head coolant jacket 71. Small indentations 121 (or equivalently, protrusions or both) are cast into critical surfaces as a means of increasing the effective surface area available for heat transfer. The portions of the hybrid core for defining these small indentations 121 (or protrusions) are made from ceramic material, and are attached to the remaining sand portion 122 of the core 120. As with the hybrid cores discussed above, hybrid cores for making these indentations (or protrusions) allow them to be small, with a cross sectional area of less than 10 millimeters.

Core Packs

As indicated above, the above-described cores can be incorporated into core packs.

Figure 13:
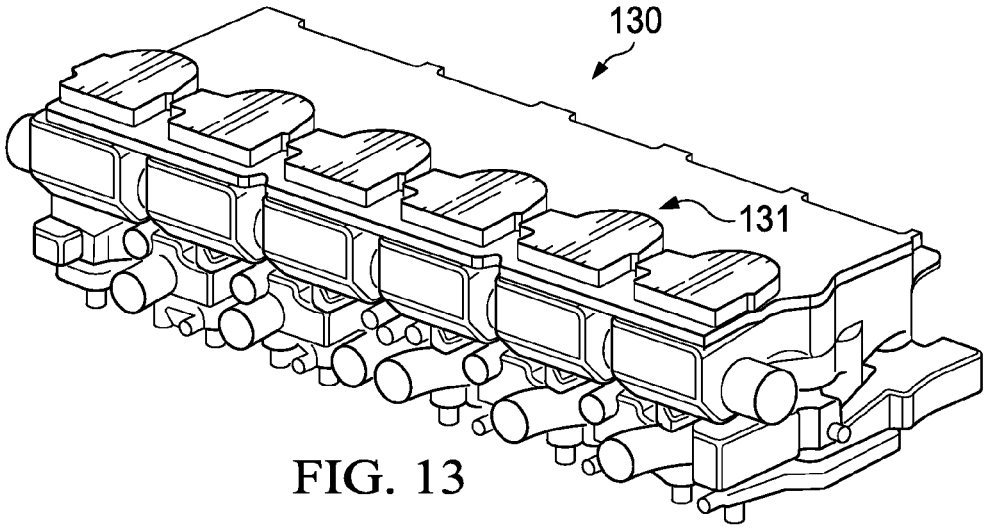
FIG. 13 illustrates an example of a core pack for an engine cylinder head.
Figure 14:
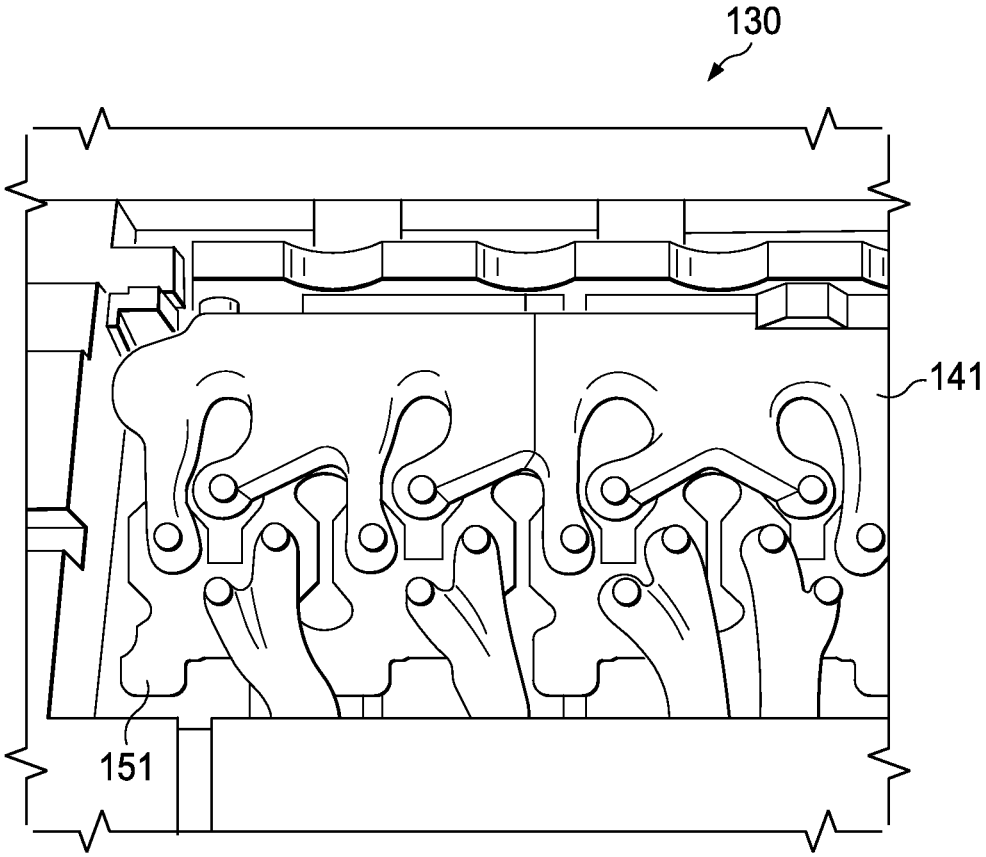
FIG. 14 illustrates an example of a portion of the core pack of FIG. 13.

FIG. 13 is a perspective view of a core pack 130 for an engine cylinder head, and FIG. 14 illustrates a portion of core pack 130 in further detail. The core 141 that defines the intake and exhaust ports incorporates sand/ceramic cores for the intake ports described above in connection with FIGS. 7-9. A portion of the core 151 that defines a conventional coolant jacket is also shown. This core incorporates sand/ceramic cores coolant jacket surface described above in connection with FIG. 12. Alternatively, core 151 could be replaced with cores for the flow lines described above in connection with FIGS. 10 and 11.

Figure 15:
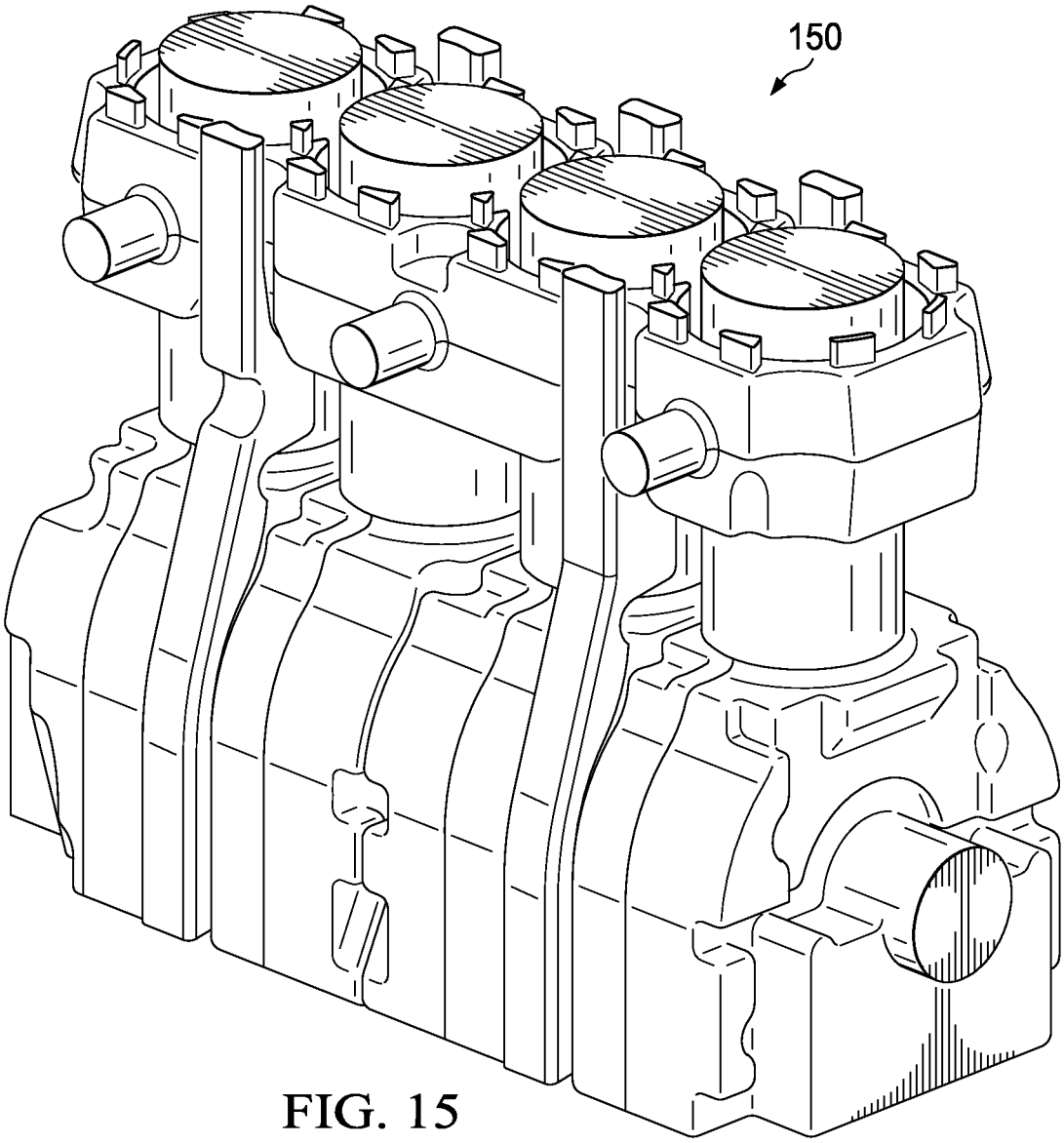
FIG. 15 illustrates an example of a core pack for an engine cylinder block.

FIG. 15 is a perspective view of a core pack 150 for an engine cylinder block. It incorporates the sand/ceramic cores for the coolant jacket described above in connection with FIGS. 3 and 4. It also incorporates the ceramic cores for the fluid flow lines described above in connection with FIGS. 5 and 6.

What is claimed is:

1. A hybrid ceramic/sand casting method of manufacturing a cylinder block or cylinder head for an internal combustion engine, the cylinder block or cylinder head having at least one small passage or hole, comprising:

providing a hybrid core having at least one ceramic section and at least one sand section;

wherein the ceramic section is used to create the at least one small passage or hole, either having a cross sectional dimension or radius of curvature dimension of less than 5 millimeters;

creating a mold cavity for the cylinder head or cylinder block;

positioning the hybrid core in the mold;

introducing molten metal into the mold;

removing the core, after the metal cools, thereby forming the cylinder block or cylinder head;

wherein the hybrid core is used to form one or more of the following parts of the cylinder block or cylinder head: a water jacket or coolant jacket, fluid flow lines or tubes, and/or an air intake port.

2. The method of claim 1, wherein the ceramic core is made independently from the sand core, and the sand core then attached to the ceramic core.

3. The method of claim 1, wherein the ceramic core has at least one lug, and the sand core is attached to the lug by being formed around the lug.

4. The method of claim 1, wherein the ceramic core is manufactured by means of injection molding.

5. The method of claim 1, wherein the hybrid core is used to form an interbore water jacket in the cylinder block, and has multiple ceramic sections, each forming an interbore bridge.

6. The method of claim 1, wherein the hybrid core is used to form fluid flow lines in the cylinder block, and wherein the ceramic section is used to form a passage of the fluid flow line having a cross section of less than 5 millimeters.

7. The method of claim 1, wherein the hybrid core is used to form fluid flow lines in the cylinder block, and wherein the ceramic section is used to form a passage of the fluid flow line having a bend radius of less than 5 millimeters.

8. The method of claim 1, wherein the hybrid core is used to form fluid flow lines in the cylinder block, and wherein the ceramic section is used to form passage of the fluid flow line having a tapered cross section.

9. The method of claim 1, wherein the hybrid core is used to form an air intake port in the cylinder head, and wherein the ceramic section is used to form a portion of the air intake port having a radius of curvature of less than 5 millimeters.

10. The method of claim 1, wherein the hybrid core is used to form flow tubes for providing coolant within the cylinder head.

11. The method of claim 1, wherein the hybrid core is used to form indentations or protrusions on the surface of a coolant jacket within the cylinder head.

* * * * *